United States Patent [19]

Honda et al.

[11] 4,292,078

[45] Sep. 29, 1981

[54] ELECTRICAL CONTACT MATERIAL

[75] Inventors: Sinya Honda, Kasuga; Takeshi Komura, Fukuoka; Naomi Sugita, Fukuoka; Tatuya Okamoto, Fukuoka, all of Japan

[73] Assignee: Nippon Tungsten Co., Ltd., Fukuoka, Japan

[21] Appl. No.: 91,301

[22] Filed: Nov. 5, 1979

[30] Foreign Application Priority Data

Nov. 7, 1978 [JP] Japan ..... 53-137653

[51] Int. Cl.[3] ..... C22C 27/04

[52] U.S. Cl. ..... 75/176; 75/244; 75/248; 148/11.5 P

[58] Field of Search ..... 75/176, 254, 244, 248; 148/11.5 F, 11.5 P

[56] References Cited

FOREIGN PATENT DOCUMENTS

| | | | |
|---|---|---|---|
| 1291894 | 3/1962 | France | 75/176 |
| 52-22197 | 2/1977 | Japan | 75/176 |
| 17610 | of 1908 | United Kingdom | 75/176 |
| 898811 | 6/1962 | United Kingdom | 75/176 |

*Primary Examiner*—Peter K. Skiff

*Attorney, Agent, or Firm*—Jordan and Hamburg

[57] ABSTRACT

Electrical contact material of this invention consists of 10 to 20 percent by weight of nickel, 0.05 to 2 percent by weight of titanium boride and the balance tungsten. Conventionally, nickel-tungsten alloy shows poor mechanical properties (e.g. brittleness) although the alloy shows high oxidation resistance and can be produced in an inexpensive way. Inclusion of titanium boride greatly improves the mechanical properties of such alloy, thereby enabling the cheap production of electrical contact material which has sufficient practical use.

1 Claim, 2 Drawing Figures

ELECTRICAL CONTACT MATERIAL

BACKGROUND OF THE INVENTION

Conventionally, pure-tungsten contacts have been predominantly used as electrical contacts for automobile distributors or for magnetos of autocycles.

Tungsten is used in such severe operating conditions for its favorable characteristics such as high melting point, high hardness, and high arc resistance.

The tungsten contacts are generally produced by the powder metallurgy since the metallurgy is hardly applicable to the production of tungsten contacts which has high melting point.

However, the powder metallurgy necessitates the swaging after the sintering to produce tungsten contacts of high density and such swaging requires a good deal of processing time. Thereby tungsten contacts produced by such method have been extremely expensive.

Furthermore, in a very humid atmosphere, tungsten readily forms an oxide on the surface thereof which increases the contact resistance and eventually impairs the conductivity of the contacts.

One method has been developed for overcoming the defects of the above production method so as to obtain a contact material of improved properties.

The method is based on a finding that the addition of nickel and cobalt to tungsten can provide the activated sintering. Although the method has succeeded in producing of a contact material of high oxidation resistance and also has succeeded in shortening the time necessary for the completion of the overall process, the material produced by the above method has shown poor mechanical properties. For example, when the contacts made of such material receive an impact caused by riveting or a distortion caused by brazing, the contacts readily give rise to cracks therein.

Accordingly, such contacts are rarely produced nowadays.

Accordingly, it is an object of the present invention to provide electrical contact material which can resolve the aforementioned defects of conventional contact material including pure tungsten.

It is another object of the present invention to provide electrical contact material which can be manufactured in an inexpensive manner.

It is still another object of the present invention to provide electrical contact material which has a favorable resistance to the oxidation.

It is further an object of the present invention to provide electrical contact material which has favorable mechanical properties.

DETAILED DESCRIPTION OF THE DISCLOSURE

Figure 1:
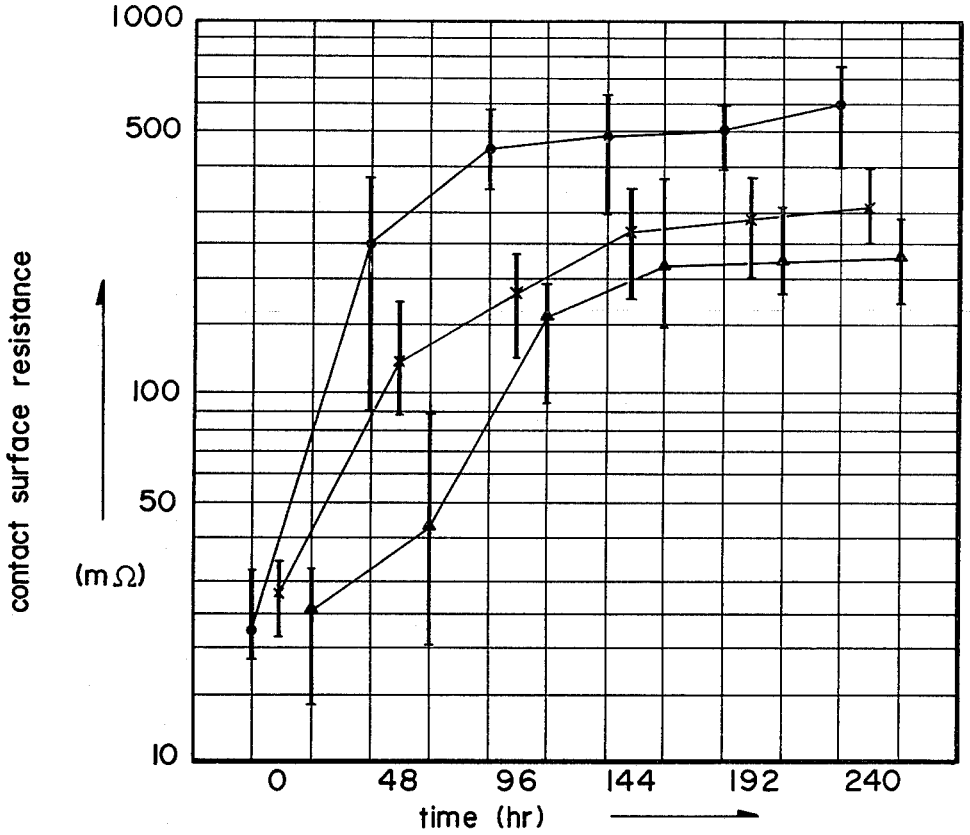
FIG. 1 is a graph showing the variation of the contact surface resistance of conventional contact(No. 1), of tungsten nickel alloy(No. 3) and the present invention measured in the oxidation resistance test, wherein the contact surface resistance is taken on the ordinate and the lapse of time on the abscissa. In the drawing, the symbol O is the curve of the test piece No. 1, the symbol X is the curve of the test piece No. 3 and the symbol Δ is the curve of the test piece No. 10.

As already described in the Background of Invention, it has been known to those skilled in the art that when an iron group element is added to tungsten, the mixture can effect activated sintering. However, the alloy produced by such sintering is extremely fragile or brittle so that the alloy has not achieved commercial success. In spite of such a fatal defect, it is also true that the alloy can improve the resistance to the oxidation which pure tungsten lacks and can be produced in a remarkably advantageous manner compared with the production of pure tungsten since (1) the alloy can be sintered at a relatively low temperature (1300°–1400° C.) compared with the sintering temperature (2900°–3100° C.) of pure tungsten and (2) the swaging which is inevitably necessary after sintering in the production of pure tungsten becomes no longer necessary. Furthermore, such alloy shows high density.

The inventors of this application have made extensive studies and efforts for finding out a solution to remove the above-mentioned fatal defect, and have succeeded in improving the brittleness while maintaining the favorable properties of the alloy.

Namely, it has been found that an addition of a small amount of titanium diboride into the tungsten-nickel alloy can remarkably improve the mechanical properties of the alloy.

The reason why the addition of the diboride can improve the mechanical properties of the alloy is considered that the diboride strengthens the binding of the inner structure of the alloy either (1) by forming a compound of between boride and the impurities such as oxygen or hydrogen which exist in the inner structure of the alloy or (2) by eliminating such impurities from the alloy.

However, a complete analysis of the reason has not been conducted yet.

The electrical contact material of this invention is further described hereinafter in view of a following experiment.

EXPERIMENT

The manner of producing the alloys is described by taking a test piece No. 10 of table 1 (W—10Ni—0.5$TiB_2$ alloy) as an example.

179 g of tungsten powder having the mean particle size of 1 μm, 20 g of nickel powder having the mean particle size of 3.5 μm and 1 g of titanium diboride ($TiB_2$) powder having the mean particle size of 3 μm were prepared and mixed in a mixer along with acetone for two hours. The powder mixture was subjected to drying after mixing operation and then was molded under pressure to form disc-shaped green compacts having different sizes, namely 4.5 mm diameter×1.2 mm thickness and 13 mm diameter×3.2 mm. These compacts were sintered in the hydrogen atmosphere of an electric furnace at 1300° C. for one hour to obtain the sintered compacts (test pieces No. 10).

The physical properties of test pieces including the above test pieces No. 10 are shown in the following Table 1, wherein the test pieces produced according to this invention are compared with conventional test pieces in terms of physical properties.

TABLE 1

| NO | COMPOSITION (Wt%) W | Ni | $TiB_2$ | LOAD-CRACK STRENGTH (kg) | DENSITY ($g/cm^3$) | HARD-NESS (HRF) | CONDUC-TIVITY (IACS%) | REMARKS |
|---|---|---|---|---|---|---|---|---|
| 1 | 100 | — | — | 80–150 | 19.3 | 122 | 30 | Conventional product |
| 2 | 95 | 5 | — | 30–40 | 18.0 | 119 | 21 | Conventional product |
| 3 | 90 | 10 | — | 60–70 | 17.3 | 119 | 16 | Conventional product |
| 4 | 85 | 15 | — | 75–90 | 16.0 | 117 | 13 | Conventional product |
| 5 | 80 | 20 | — | 100–110 | 14.7 | 115 | 10 | Conventional product |
| 6 | 94.95 | 5 | 0.05 | 48–62 | 17.7 | 120 | 17 | Product of this invention |
| 7 | 94.5 | 5 | 0.5 | 44–52 | 17.4 | 117 | 16 | Product of this invention |
| 8 | 93 | 5 | 2 | 42–59 | 16.4 | 120 | 11 | Product of this invention |
| 9 | 89.95 | 10 | 0.05 | 78–89 | 17.1 | 117 | 15 | Product of this invention |
| 10 | 89.5 | 10 | 0.5 | 80–90 | 16.6 | 116 | 14 | Product of this invention |
| 11 | 89 | 10 | 1.0 | 82–93 | 16.2 | 118 | 13 | Product of this invention |
| 12 | 84.8 | 15 | 0.2 | 75–106 | 16 | 118 | 12 | Product of this invention |
| 13 | 84 | 15 | 1.0 | more than 150 | 15.7 | 118 | 11 | Product of this invention |
| 14 | 79.95 | 20 | 0.05 | more than 150 | 15.4 | 120 | 9 | Product of this invention |
| 15 | 79.5 | 20 | 0.5 | more than 150 | 15.2 | 118 | 9 | Product of this invention |
| 16 | 78 | 20 | 2.0 | 128–138 | 14.3 | 117 | 8 | Product of this invention |

(Note)
In the table 1, "load crack strength" means the load which causes cracks in the test piece. Such load is measured in such a manner that a recess is formed on reasons. Metallic boride is usually produced industrially by a testing table, a disc-shaped test piece having the size of 4 mm diameter × 1 mm thickness is mounted on the recess and a load is gradually applied to the disc-shaped test piece by way of a steel ball having the diameter of 6 mm until cracks occur in the test piece.

As can be readily understood from Table 1, the test piece of this invention showed higher pressure-crack strength compared with the tungsten-nickel alloy test pieces. Especially the test pieces of this invention which contains more than 10 percent of nickel showed strength comparable to the strength of pure tungsten test piece.

Among the test pieces shown in Table 1, three test pieces Nos. 1, 3 and 10 were picked up and were placed in a thermohydrostat which was held at a temperature of 40 degrees centigrade and a relative humidity of 90 percent for conducting an oxidation resistance test. The test was substantially conducted by measuring the variation of the contact surface resistance of each test piece. The result of the oxidation resistance test was shown in FIG. 1.

As can be understood from FIG. 1, the contact surface resistance of the pure-tungsten test piece exceeded 400 mΩ in the fourth day, whereas the contact surface resistance of the tungsten-nickel alloy test pieces and test pieces of this invention showed about 300 mΩ even after the tenth day. This implies that the test piece of this invention have a considerably favorable oxidation resistance compared to that of the pure tungsten test piece.

Subsequently, for testing the electrical performance of the test pieces, the test pieces in Table 1 were mounted on a magneto and were subjected to a make-and-break test under the following test conditions;

| | |
|---|---|
| Operating voltage between contacts | 14 V |
| Current | 2.5 A |
| Frequency of make-and-break of loaded ignition coil | 8000 times/minute |
| Operating time | 240 hours |

Figure 2:
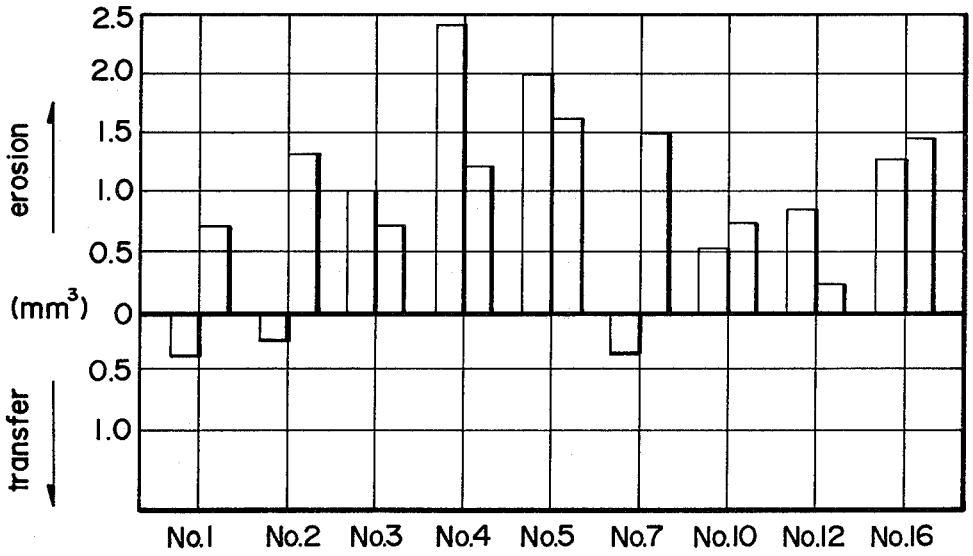
FIG. 2 is a graph showing the result of the electrical performance test of the test pieces of this invention and conventional test pieces, wherein the erosion is taken on the upper ordinate, the transfer is taken on the lower ordinate and test pieces are taken on the abscissa. In each test piece, the left column shows the movable contact while the right column shows the stationary contact.

The results of the test are shown in FIG. 2. As can be understood from FIG. 2, the test pieces of this invention showed the erosion (arc erosion+mechanical wear) which is comparable to that of conventional pure-tungsten test piece.

This implies that the electrical contacts produced according to this invention can be used in practical operation instead of conventional electrical contacts.

When observing the wear process of the test pieces, it has been found that the conventional contact (test piece) showed a pit or depression in the stationary contact and a cone on the movable contact, namely a "transfer" occured on the contacts (test pieces).

Whereas, the contacts of this invention showed ideal wear patterns, namely flat even wear patterns on both stationary contact and movable contact provided that the nickel amount of the alloys exceeded 10 percent. It is also found from the analysis of the result of the experiment that the amount of nickel to be added should be 10 percent to 20 percent since the contact material containing less than 10 percent of nickel was excessively brittle and the addition of boride to the material could not provide the required strength while the contact material containing more than 20 percent of nickel showed the rapid arc erosion and/or mechanical wear as well as excessively low conductivity. The amount of boride should be 0.05 percent to 2 percent since the contact material containing less than 0.05 percent of boride showed poor improvement in view of brittleness while the contact material containing more than 2 percent of boride lowered the strength of the material.

As has been described above, the contact material of this invention (1) improves the oxidation resistance which pure tungsten lacks, (2) shows the electrical performance which is comparable to conventional contact material, (3) greatly shortens and simplifies the production process, and (4) furthermore improves the yielding rate of production.

What we claim is:

1. Electrical contact material consisting essential of 10 to 20 percent by weight of nickel, 0.05 to 2.0 percent by weight of titanium diboride and the balance tungsten.

* * * * *